US005499713A

United States Patent [19]

Huffer

[11] Patent Number: 5,499,713

[45] Date of Patent: Mar. 19, 1996

[54] TRANSPARENT REMOTE CONTROL FLEXIBLE ENVELOPE

[76] Inventor: Richard L. Huffer, 454 S. Harrison St., Frankfort, Ind. 46041-2405

[21] Appl. No.: 340,597

[22] Filed: Nov. 16, 1994

[51] Int. Cl.[6] ..... B65D 85/38; B65D 65/16

[52] U.S. Cl. ..... 206/305; 206/45.33; 206/320; 206/813

[58] Field of Search ..... 206/305, 320, 206/45.33, 45.34, 813; 229/87.06; 383/86

[56] References Cited

U.S. PATENT DOCUMENTS

| | | | |
|---|---|---|---|
| 2,215,989 | 9/1940 | Wolf | 383/86 X |
| 2,271,279 | 1/1942 | Thomas | 383/86 X |
| 2,925,675 | 2/1960 | Lumpkin | 206/813 X |
| 3,310,225 | 3/1967 | Hoblit et al. | 383/86 |
| 4,573,573 | 3/1986 | Favaro | 206/305 |
| 4,762,227 | 8/1988 | Patterson | 206/305 X |
| 4,858,756 | 8/1989 | Herrin et al. | 206/45.39 |
| 4,987,999 | 1/1991 | Hehn | 206/45.34 X |
| 5,092,459 | 3/1992 | Uljanic et al. | 206/320 |
| 5,316,141 | 5/1994 | Jalomo | 206/320 |
| 5,388,692 | 2/1995 | Withrow et al. | 206/320 |

*Primary Examiner*—Bryon P. Gehman

[57] ABSTRACT

An envelope for closing and protecting a remote control. The inventive device includes a transparent envelope having at least one closing web permitting entrance of the remote control thereinto. The envelope is flexible to permit operation of the remote control through a depression of the envelope material. A plurality of gripper pads are secured to the envelope to preclude a slipping of the device from a support structure, such as an armrest of a chair.

5 Claims, 3 Drawing Sheets

FIG. 3
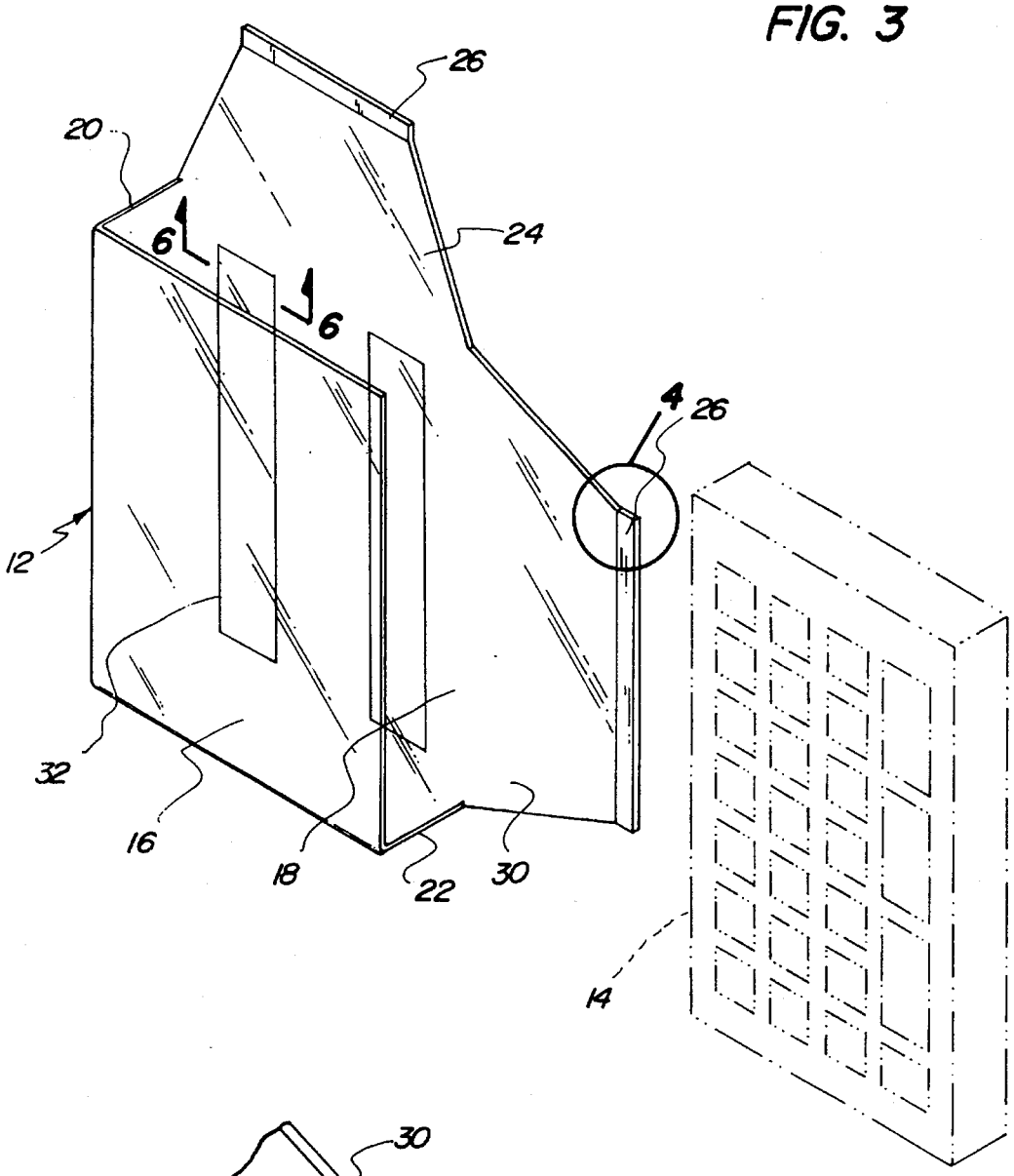
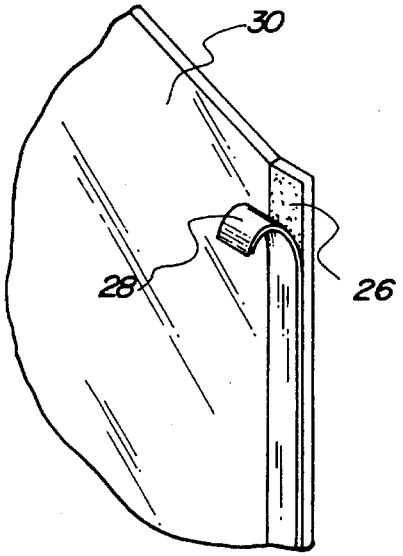
FIG. 4

TRANSPARENT REMOTE CONTROL FLEXIBLE ENVELOPE

BACKGROUND OF THE INVENTION

1. Field of the Invention

The present invention relates to covering structures and more particularly pertains to a remote control flexible envelope for enclosing and protecting a remote control.

2. Description of the Prior Art

The use of covering structures is known in the prior art. More specifically, covering structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art covering structures include U.S. Pat. Nos. 5,092,459; 4,836,256; 4,768,230; 4,762,227; 4,733,776; and 4,703,160.

While these devices fulfill their respective, particular objectives and requirements, the aforementioned patents do not disclose a remote control flexible envelope for enclosing and protecting a remote control which includes a transparent envelope having at least one closing web permitting entrance of the remote control thereinto, and a plurality of gripper pads secured to the envelope to preclude a slipping of the device from a support surface.

In these respects, the remote control flexible envelope according to the present invention substantially departs from the conventional concepts and designs of the prior art, and in so doing provides an apparatus primarily developed for the purpose of enclosing and protecting a remote control.

SUMMARY OF THE INVENTION

In view of the foregoing disadvantages inherent in the known types of covering structures now present in the prior art, the present invention provides a new remote control flexible envelope construction wherein the same can be utilized for enclosing and protecting a remote control. As such, the general purpose of the present invention, which will be described subsequently in greater detail, is to provide a new remote control flexible envelope apparatus and method which has many of the advantages of the covering structures mentioned heretofore and many novel features that result in a remote control flexible envelope which is not anticipated, rendered obvious, suggested, or even implied by any of the prior art covering structures, either alone or in any combination thereof.

To attain this, the present invention generally comprises an envelope for closing and protecting a remote control. The inventive device includes a transparent envelope having at least one closing web permitting entrance of the remote control thereinto. The envelope is flexible to permit operation of the remote control through a depression of the envelope material. A plurality of gripper pads are secured to the envelope to preclude a slipping of the device from a support structure, such as an armrest of a chair.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new remote control flexible envelope apparatus and method which has many of the advantages of the covering structures mentioned heretofore and many novel features that result in a remote control flexible envelope which is not anticipated, rendered obvious, suggested, or even implied by any of the prior art covering structures, either alone or in any combination thereof.

It is another object of the present invention to provide a new remote control flexible envelope which may be easily and efficiently manufactured and marketed.

It is a further object of the present invention to provide a new remote control flexible envelope which is of a durable and reliable construction.

An even further object of the present invention is to provide a new remote control flexible envelope which is susceptible of a low cost of manufacture with regard to both materials and labor, and which accordingly is then susceptible of low prices of sale to the consuming public, thereby making such remote control flexible envelopes economically available to the buying public.

Still yet another object of the present invention is to provide a new remote control flexible envelope which provides in the apparatuses and methods of the prior art some of the advantages thereof, while simultaneously overcoming some of the disadvantages normally associated therewith.

Still another object of the present invention is to provide a new remote control flexible envelope for enclosing and protecting a remote control.

Yet another object of the present invention is to provide a new remote control flexible envelope which includes a transparent envelope having at least one closing web permitting entrance of the remote control thereinto, and a plurality of gripper pads secured to the envelope to preclude a slipping of the device from a support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of an alternative form of the present invention.

FIG. 4 is an enlarged isometric illustration of the area set forth in FIG. 3.

DESCRIPTION OF THE PREFERRED EMBODIMENT

Figure 1:
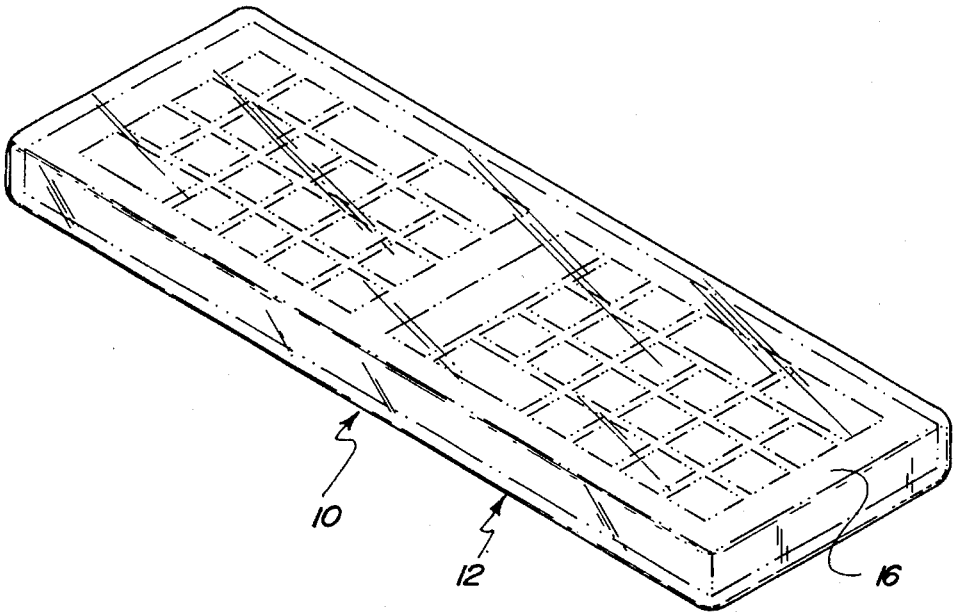
FIG. 1 is an isometric illustration of a remote control flexible envelope according to the present invention in use.

With reference now to the drawings, and in particular to FIGS. 1–6 thereof, a new remote control flexible envelope embodying the principles and concepts of the present invention and generally designated by the reference numeral 10 will be described.

Figure 2:
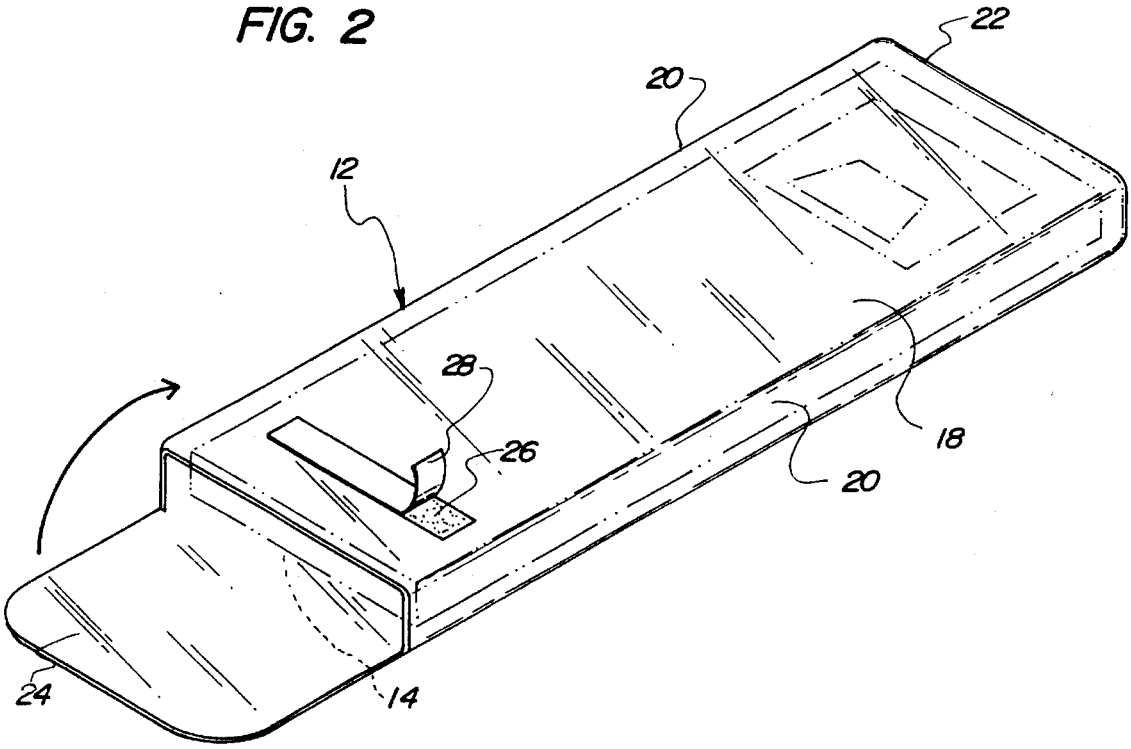
FIG. 2 is a further isometric illustration of the present invention.

More specifically, it will be noted that the remote control flexible envelope 10 comprises a transparent envelope 12 for receiving a remote control 14 therewithin, such as is shown in FIG. 2 of the drawing. The transparent envelope 12 is shaped so as to define a front wall web 16 spaced from a rear wall web 18, with a pair of side wall webs 20 extending substantially orthogonally between the front and rear wall webs. A bottom wall web 22 extends across a closed end of the transparent envelope 12 and is oriented so as to extend substantially orthogonally between the front and rear wall webs 16, 18 as well as the side wall webs 20 to define the substantially rectangular shape of the transparent envelope 12. A top closing web 24 is coupled to the front wall web 16 proximal to an open end of the transparent envelope 12 and is operable to be engaged to a portion of the rear wall web 18 to couple with an adhesive securing strip 26 secured to the rear wall web. A removable backing 28 covers the adhesive securing strip 26 during transportation and/or storage of the device 10. By this structure, the remote control 14 can be positioned through the open end of the transparent envelope 12, with the top closing web 24 being positioned into abutting engagement with the rear wall web 18 to couple with the adhesive securing strip 26 subsequent to a removal of the removable backing 28, whereby the remote control will be contained within the envelope 12 and protected from damage thereto as a result of fluids or the like being spilled onto the device 10. The transparent envelope 12 is constructed of a substantially resilient and transparent material which permits operation of the remote control through a resilient deformation of such material.

As illustrated in FIGS. 3 through 6 of the drawings, it can be shown that the present invention 10 may comprise, in lieu of one of the side wall webs 20, a lateral closing web 30 which extends from the rear wall web 18 to removably couple with the front wall web 16. To this end, the transparent envelope 12 illustrated in FIGS. 3 through 6 of the drawings comprises a front wall web 16 spaced from and oriented parallel to a rear wall web 18, with a single side wall web 20 extending orthogonally between the front and rear wall webs 16, 18. A bottom wall web 22 extends across a lower end of the transparent envelope 12 and is oriented so as to extend substantially orthogonally relative to the front and rear wall webs 16, 18 as well as the side wall web 20 to define the substantially rectangular shape of the transparent envelope 12. The lateral closing web 30 extends from the rear wall web 18 and projects outwardly therefrom. Similarly, the top closing web 24 projects from the rear wall web 18 upwardly therefrom such that the remote control 14 can be positioned within the transparent envelope 12 and secured therewithin by adhesive securing strips 26 coupled to outer distal ends of the closing webs 24, 30. The adhesive securing strips 26 are each covered by a removable backing 28, as illustrated in FIG. 4, whereby a removal of the removable backing 28 permits adhesive securement of the adhesive securing strip 26 to the front wall web 16 to capture the remote control 14 within the transparent envelope 12. By this structure, remote control units 14 of varying sizes can be captured within the transparent envelope 12 of fixed size to impart a universal fitting of the device 10.

Figure 5:
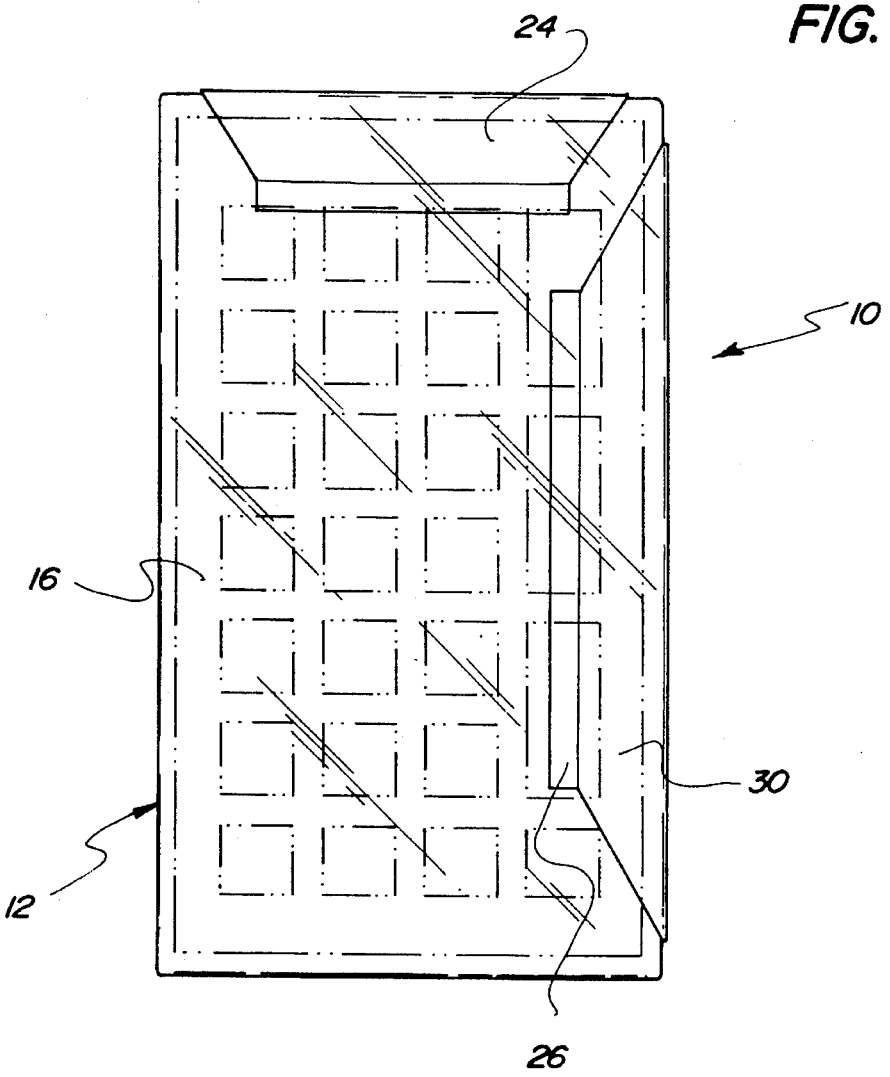
FIG. 5 is a top plan view of the alternative form of the invention.
Figure 6:
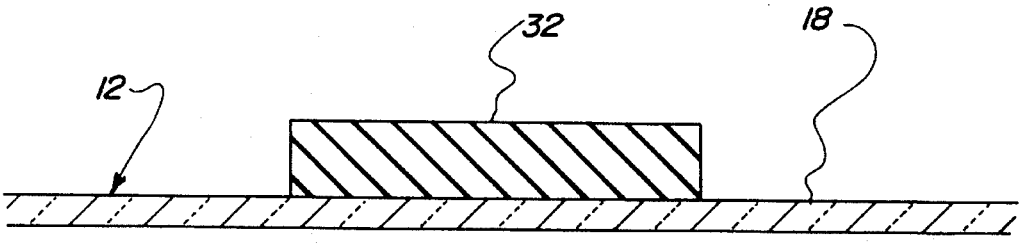
FIG. 6 is a cross-sectional view taken along line 6—6 of FIG. 3.

As shown in FIG. 5, the closing webs 24, 30 extend about the remote control unit 14 and are secured to the front wall web 16 by the adhesive securing strip 26. To this end, the adhesive securing strip 26 is preferably transparent in construction so as to permit the visual identification of the buttons positioned beneath the front wall web 16.

To preclude an unintentional movement of the device 10 and the associated remote control 14 relative to a support surface, such as an armrest of a chair or the like, the present invention 10 additionally comprises a pair of elongated gripping pads 32 secured to the rear wall web 18 of the transparent envelope 12. The elongated gripping pads 32 are oriented in a substantially spaced and parallel orientation and extend parallel to the side wall web 20 of the transparent envelope 12. By this structure, a positioning of the remote control 14 within the associated transparent envelope 12 onto an armrest of an unillustrated chair will position the elongated gripping pads 32 proximal to opposed lateral edges of the armrest to preclude a rotation of the device 10 about an axis directed perpendicularly through the bottom wall web 22 which would result in a slipping of the device and associated remote control 14 from the armrest. In other words, an arcuate portion of the armrest will project between the elongated gripping pads 32 when the device 10 is placed thereupon, with each gripping pad 32 serving to engage the armrest and preclude rotation of the device 10 about the axis directed perpendicularly through the bottom wall web 22 to preclude such slipping and subsequent falling of the device 10 and associated remote 14. Preferably, the elongated gripping pads are each comprised of a substantially resilient material which, in combination with the resiliency of the rear wall web 18, permits the elongated gripping pads to follow a contour of a rear surface of the remote control 14 against which they are positioned.

In use, the remote control flexible envelope 10 according to the present invention serves to encapsulate and protect an associated remote control unit 14. Further, because of the construction and orientation of the elongated gripping pads 32, the device 10 and the associated remote control are precluded from unintentional disengagement with an armrest of an associated chair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remote control flexible envelope comprising:

a transparent envelope for receiving a remote control, the transparent envelope being shaped so as to define a front wall web spaced from a rear wall web, with a single side wall web extending orthogonally between the front and rear wall webs, a bottom wall web extending across a lower end of the transparent envelope and being oriented so as to extend substantially orthogonally relative to the front and rear wall webs and the side wall web to define a substantially rectangular shape of the transparent envelope, a lateral closing web extending from the rear wall web and projecting outwardly therefrom, and a top closing web projecting from the rear wall web proximal to an open end of the envelope; and, a plurality of adhesive securing strips, each of said adhesive securing strips being coupled to an outer distal end of an individual one of the closing webs for securing the closing web to the front wall web to capture a remote control within the transparent envelope;

wherein the adhesive securing strips are transparent in construction so as to permit a visual identification of buttons of a remote control positioned beneath the front wall web.

2. The remote control flexible envelope of claim 1, and further comprising a pair of elongated gripping pads secured to the rear wall web of the transparent envelope.

3. The remote control flexible envelope of claim 2, wherein, the elongated gripping pads are oriented in a substantially spaced and parallel orientation and extending parallel to the side wall web of the transparent envelope such that a positioning of the transparent envelope onto an arcuate armrest of a chair will position the elongated gripping pads proximal to opposed lateral edges of the armrest with an arcuate portion of the armrest projecting between the elongated gripping pads to preclude a rotation of the envelope about an axis directed perpendicularly through the bottom wall web.

4. The remote control flexible envelope of claim 3, wherein the gripping pads are each comprised of a substantially resilient material which permits the elongated gripping pads to follow a contour of a rear surface of a remote control.

5. A remote control flexible envelope comprising:

a transparent envelope for receiving a remote control, the transparent envelope being shaped so as to define a front wall web spaced from a rear wall web, with a single side wall web extending between the front and rear wall webs, a bottom wall web extending across a lower end of the transparent envelope, at least one closing web extending from the rear wall web and projecting outwardly therefrom; and, at least one adhesive securing strip, said adhesive securing strip being coupled to an outer distal end of the closing web for securing the closing web to the front wall web to capture a remote control within the transparent envelope, the adhesive securing strip being transparent in construction so as to permit a visual identification of buttons of a remote control positioned beneath the front wall web.

* * * * *